United States Patent [19]

Schulz et al.

[11] Patent Number: 4,953,350

[45] Date of Patent: Sep. 4, 1990

[54] FUNNEL FOR A FUNNEL SPINNING APPARATUS ON A TEXTILE MACHINE

[75] Inventors: Günter Schulz, Ebersbach/Fils; Frieder Probst, Eislingen; Hermann Güttler, Uhingen, all of Fed. Rep. of Germany

[73] Assignee: Zinser Textilmaschinen GmbH, Fed. Rep. of Germany

[21] Appl. No.: 340,382

[22] Filed: Apr. 19, 1989

[30] Foreign Application Priority Data

Apr. 21, 1988 [DE] Fed. Rep. of Germany ..... 3812267

[51] Int. Cl.[5] ..... D01H 7/00; D01H 7/26; D01H 7/66; D01H 13/04

[52] U.S. Cl. ..... 57/354; 57/67; 57/74; 57/115; 57/127

[58] Field of Search ..... 57/67–71, 57/115–117, 354, 127, 73, 74, 352

[56] References Cited

U.S. PATENT DOCUMENTS 2,500,827 3/1950 Ickringill ..... 57/115
2,867,970 1/1959 Richter ..... 57/115
4,592,196 6/1986 Wolf ..... 57/74
4,779,409 10/1988 Marchiori et al. ..... 57/67 X

FOREIGN PATENT DOCUMENTS 917358 8/1954 Fed. Rep. of Germany .
3400327 7/1985 Fed. Rep. of Germany .

*Primary Examiner*—John Petrakes
*Attorney, Agent, or Firm*—Shefte, Pinckney & Sawyer

[57] ABSTRACT

A yarn feeding funnel for a textile spinning machine having an upper shaft portion and a body portion. A yarn inlet opening in the upper shaft portion is radially offset from the axis of rotation of the yarn feeding funnel and facilitates the formation of a yarn balloon of controlled extent between the yarn inlet opening and a yarn guiding eye which is coaxial with the funnel rotation axis. A plurality of alternative yarn inlet openings, each at a predetermined, different radial spacing from the funnel rotation axis, may be provided to vary the characteristics, such as the diameter, of the yarn balloon formed between the yarn inlet opening and the yarn guiding eye.

9 Claims, 1 Drawing Sheet

FUNNEL FOR A FUNNEL SPINNING APPARATUS ON A TEXTILE MACHINE

BACKGROUND OF THE INVENTION

The present invention relates to a funnel for a funnel spinning apparatus on a textile machine and, more particularly, to such a funnel which is rotatably supported in yarn guiding relation to a bobbin.

In the operation of a funnel spinning apparatus as disclosed in German Patent No. A 34 00 327, a funnel is disclosed which completely suppresses the formation of a yarn balloon during the feed of yarn through the funnel to the bobbin. The complete suppression of the formation of a yarn balloon enables the rate of spinning to be correspondingly increased since the speed limiting characteristics of a yarn balloon are not present. However, the winding speed of the yarn as it is wound on the bobbin varies and, accordingly, the tension of the yarn on the bobbin varies in accordance with the variations in the speed with which the yarn is delivered onto the bobbin. To compensate for the variations in the yarn tension, the yarn is arranged to travel in a spiral along the outside surface of the funnel and the slope of the spiral adjusts itself in correspondence with the variations in the yarn tension to compensate therefor.

In European Patent Application No. A 0 225 660, a funnel is disclosed for feeding yarn onto a bobbin, the funnel having a cylindrical portion connected to a barrel-like portion. The yarn travels through the interior of the cylindrical portion and passes through an outlet opening to the outside of the funnel to travel on the outside surface of the barrel-like portion. During the travel of the yarn through the cylindrical portion and in the portion of the funnel prior to the cylindrical portion in the direction of travel of the yarn, a yarn balloon is caused to be formed. The funnel is rotatably supported by a bearing engaging the cylindrical portion of the funnel. However, the bearing must be of a relatively large size so that the potential rate of spinning is not limited.

SUMMARY OF THE INVENTION

The present invention provides a yarn feeding funnel for a funnel spinning apparatus of a textile spinning machine to feed yarn onto a bobbin which enhances the capability of the yarn traveling thereacross to automatically adjust to variations in the yarn tension.

Briefly described, the present invention provides a yarn feeding funnel for use in a textile machine of the type in which yarn is wound on a bobbin and which has a bearing for rotatably supporting the yarn feeding funnel in yarn guiding relation to the bobbin. The yarn feeding funnel includes an upper shaft portion and a body portion. The upper shaft portion has a yarn inlet opening and a yarn passage extending from the inlet opening for passage of yarn through the upper shaft portion, the upper shaft portion being rotatably supportable above the bobbin by the bearing for rotation about an axis and the inlet opening being radially offset from the axis. The body portion extends downwardly from the upper shaft portion and has a yarn passage extending from the yarn passage in the upper shaft portion to an outlet opening for passage of yarn traveling from the upper shaft portion through the body portion to the outside of the funnel for feeding to the bobbin.

Preferably, the upper shaft portion is fixed to the body portion for rotation therewith. In one preferred embodiment, the upper shaft portion includes a journal segment adapted to cooperate with the bearing for rotatably supporting the upper shaft portion and a top segment defining the yarn inlet opening, the top segment being fitted to the journal segment. In another preferred embodiment of the present invention, a portion of the yarn passage in the upper shaft portion extends along the axis.

In an alternative embodiment of the present invention, the top segment has a radial extent greater than the journal segment and the yarn inlet opening is located at a greater radial spacing from the axis than the periphery of the journal segment. According to another preferred embodiment of the present invention, the top segment is releasably fitted to the journal segment.

DETAILED DESCRIPTION OF THE PREFERRED EMBODIMENTS

Figure 1:
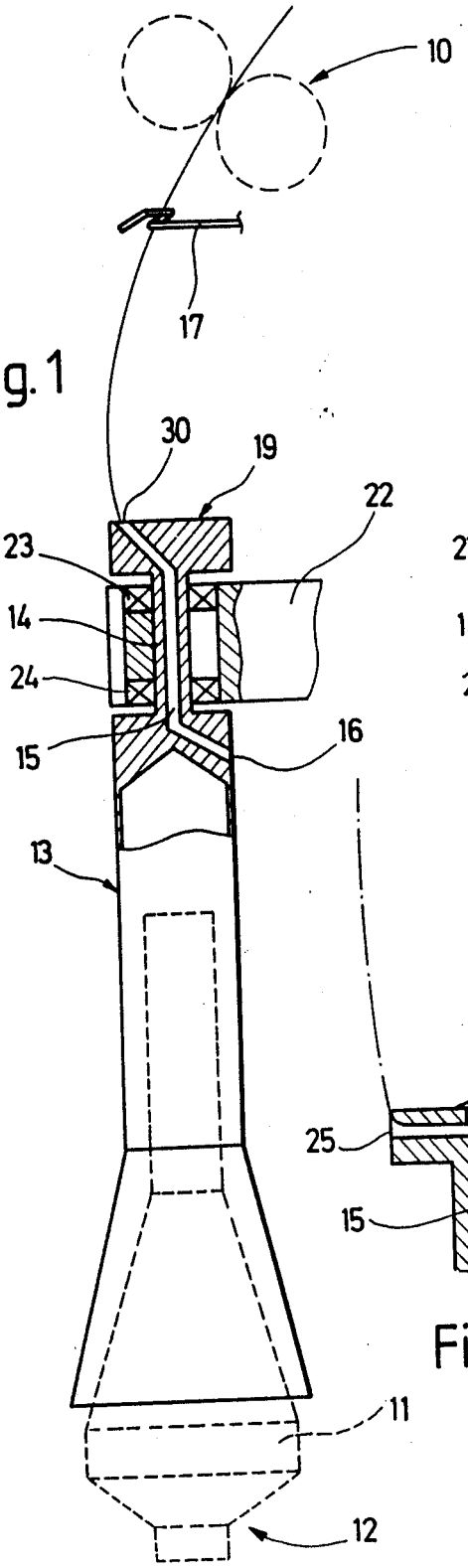
FIG. 1 is an elevational view of one preferred embodiment of the funnel of the present invention, partially in vertical section.

One preferred embodiment of the funnel of the present invention for use in a funnel spinning apparatus of a textile machine is illustrated in FIG. 1 and is generally designated as 13. An example of a funnel spinning device in which the funnel of the present invention may be used is described in German Patent No. 34 00 327 and this device is positioned in operating relation with the drafting mechanism 10 of the textile machine for the feed of yarn from the drafting mechanism 10 to the funnel. The funnel 13 encircles, in a non-contacting manner, the upper portion of a rotating bobbin 12 which is reciprocated vertically within and advanced out of the hollow lower end of the funnel 13 to build a yarn package 11 on the bobbin 12.

The funnel 13 includes an upper shaft portion 14 having a journal segment, the journal segment being rotatably supported by a pair of bearings 23, 24 of a supporting frame 22 of the textile machine, and a body portion extending downwardly from the upper shaft portion 14. The body portion includes an upper cylindrical segment having an inner diameter greater than the diameter of the bobbin 12 on which the yarn package 11 is built, and a conically outwardly flaring lower segment. The upper shaft portion 14 has a yarn inlet opening 30 and a yarn passage extending from the yarn inlet opening 30, the yarn passage through the upper shaft portion 14 including a yarn passage portion 15 axially aligned with the axis of rotation of the funnel 13. The yarn inlet opening 30 is defined by a top segment 19 of the upper shaft portion 14 and the top segment 19 has a greater radial extent than the journal segment with the yarn inlet opening 30 being located at a greater radial spacing from the axis of the journal segment than the outside periphery of the journal segment. The body portion includes a yarn passage extending from the yarn passage of the upper shaft portion 14 to an outlet opening 16, the yarn passages of the upper shaft portion 14 and the body portion cooperating together for passage of yarn therethrough traveling from the drafting mechanism 10. Accordingly, the yarn travels from the drafting mechanism 10 of the textile machine through a yarn guiding eye 17 coaxial with the funnel 13 through the yarn inlet opening 30, along the yarn passages of the upper shaft portion 14 and the upper body portion and through the outlet opening 16 to the outside of the funnel for feeding onto the bobbin 12.

To facilitate the formation of a yarn balloon of a predetermined, controlled extent, the yarn inlet opening 30 is radially offset from the rotation axis of the funnel 13. The formation of a yarn balloon outside of the funnel allows the journal segment of the upper shaft portion 14 to be constructed of a relatively small diameter since no yarn balloon is formed therein. The characteristics of the yarn balloon vary in response to the vertical distance between the yarn guiding eye 17 and the yarn inlet opening 30 and in response to the radial spacing of the yarn inlet opening 30 from the funnel rotation axis. On the other hand, the characteristics of the yarn balloon do not vary in response to the vertical movement of the bobbin 12 with respect to the funnel 13. Accordingly, to adjust and control the characteristics of the yarn balloon formed between the yarn inlet opening 30 and the yarn guide eye 17, the vertical or axial spacing between the yarn guide eye 17 and the yarn inlet opening 30 and the radial spacing of the yarn inlet opening 30 from the funnel rotation axis can be varied. For example, the top segment 19 can be provided with a number of alternative yarn inlet openings which can be used in lieu of the yarn inlet opening 30, each of the alternative yarn inlet openings being at a predetermined, different radial spacing from the funnel rotation axis.

Figure 2:
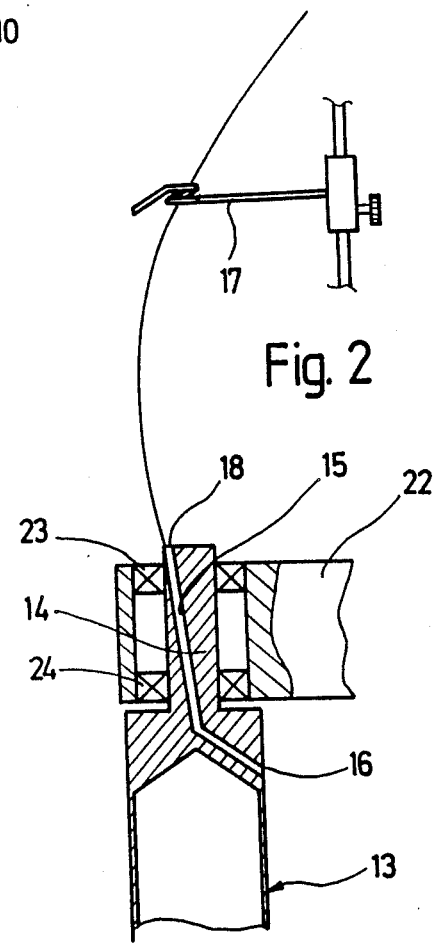
FIG. 2 is a partial vertical sectional view of another preferred embodiment of the funnel of the present invention.

In FIG. 2, another preferred embodiment of the funnel 13 of the present invention is illustrated with only the upper shaft portion 14 thereof being shown, the body portion thereof being the same as the body portion of the funnel 13 illustrated in FIG. 1. The yarn passage through the upper shaft portion 14 of the funnel, including the portion of the yarn passage extending through the journal segment of the upper shaft portion, extends at an inclination with respect to the funnel rotation axis from a yarn inlet opening 18 at the top of the upper shaft portion 14 to the yarn passage in the body portion of the funnel 13. The yarn passage through the body portion 14 is also inclined with respect to the funnel rotation axis and extends from the yarn passage of the upper shaft portion 14 to an outlet opening 16 in the body portion through which the yarn passes to the outside of the funnel. The yarn passage of the upper shaft portion 14 is inclined at a constant angle with respect to the funnel rotation axis and the yarn passage of the body portions is inclined at a different angle with respect to the funnel rotation axis. Alternatively, the present invention contemplates a funnel having the yarn passage of the upper shaft portion 14 and the yarn passage of the body portion extending along the same line at a constant inclination with respect to the funnel rotation axis, whereby the yarn travels from the yarn inlet opening 18 to the yarn outlet opening 16 along a single linear yarn passage inclined with respect to the funnel rotation axis.

As shown in FIG. 2, the yarn guiding eye 17 is connected to a means 32 for adjusting the spacing of the yarn guiding eye 17 and the yarn inlet opening 18 in a direction parallel to the axis of rotation of the funnel 13. The adjusting means 32 includes a guide pole 33 extending parallel to the axis of rotation of the funnel 13, a sleeve 34 coaxially mounted on the guide pole 33 and axially movable therealong and a set screw 35 threadably mounted to the sleeve 34. One end of the yarn guiding eye 17 is connected by adhesive or other appropriate interconnecting means to the sleeve 34 and the yarn guiding eye 17 extends generally perpendicular to the axis of the guide pole 33. By selective threading and unthreading of the set screw 35 to thread the set screw into and out of contact with the guide pole 33, the sleeve 34 can be selectively moved along the guide pole 33 and fixed in an infinite number of axial positions relative thereto to adjust the spacing of the yarn guiding eye 17 relative to the yarn inlet opening 18 in a direction parallel to the axis of rotation of the funnel 13. Thus, the ballooning of the yarn between the guiding eye 17 and the yarn inlet opening 18 can be controlled and varied as desired.

Figure 3:
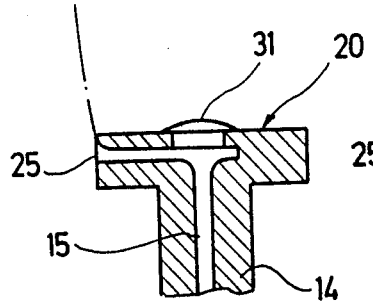
FIG. 3 is a partial vertical sectional view of an alternative embodiment of the funnel of the present invention.

In FIG. 3, an alternative embodiment of the funnel of the present invention is illustrated with only the upper shaft portion 14 thereof being illustrated, the body portion of the funnel being the same as the body portion of funnel 13 illustrated in FIG. 1. The upper shaft portion 14 includes a cylindrical top segment 20 having a greater radial extent than the journal segment of the upper shaft portion. A yarn inlet opening 25 is located on the circumference of the top segment 20 and the yarn passage extends in a radial direction from the yarn inlet opening to the central axial region of the upper shaft portion 14 and then extends through a portion 15 which is coaxial with the funnel rotation axis. An upper central opening in the top segment 20 which provides access along the funnel rotation axis to the portion 15 is covered by a cover 31. During rotation of the funnel 13, a yarn balloon forms between the yarn guiding eye 17 and the yarn inlet opening 25, as indicated by the dot-dash line in FIG. 3.

Figure 4:
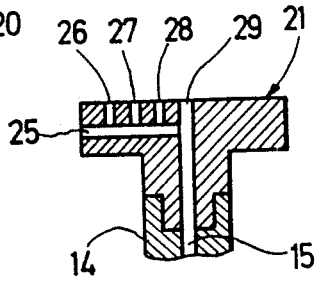
FIG. 4 is a partial vertical sectional view of another alternative embodiment of the funnel of the present invention.

In FIG. 4, another alternative embodiment of the present invention is illustrated, with only the upper shaft portion 14 thereof being shown, the body portion being the same as the body portion of the funnel 13 illustrated in FIG. 1. A cylindrical top segment 21 is releasably fitted to the journal segment of the upper shaft portion 14 and a yarn inlet opening 25 is formed on the circumference of the top segment 21. A yarn passage extends from the yarn inlet opening 25 to the central axial region of the upper shaft portion 14 and then extends along a portion 15 which is coaxial with the funnel rotation axis. A plurality of alternative yarn inlet openings 26, 27 and 28 are each located at a predetermined, different radial spacing from the funnel rotation axis along the top surface of the top segment 21 and a communicating passage extends from each alternative yarn inlet opening to the portion of the yarn passage extending from the yarn inlet opening 25 to the central axial region of the upper shaft portion 14. Accordingly, the yarn can be arranged to travel through a selected one of the alternative yarn inlet openings 26, 27 and 28 to vary the characteristics of the yarn balloon which forms between the selected yarn inlet opening and the yarn guiding eye 17. Additionally, a yarn inlet opening 29 is provided on the top surface of the top segment 21 at the center thereof and is communicated with the portion 15 of the yarn passage by a passage. Accordingly, if no yarn balloon between the yarn guiding eye 17 and the funnel 13 is to be formed, the yarn can be guided directly through the yarn inlet opening 29.

The present invention also contemplates providing blind passages, each diametrically offset from a respective one of the alternative yarn passages 26, 27 and 28, to reduce the unbalanced or eccentric forces exerted on the funnel 13. The present invention also contemplates that the yarn inlet openings 18, 25, 26, 27, 28 and 30 and the yarn outlet opening 16 can be defined by ceramic elements, which enhance the wear-resistance of the funnel 13.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A yarn feeding funnel for use in a textile machine of the type in which yarn is wound on a bobbin and which has a bearing for rotatably supporting the yarn feeding funnel in yarn guiding relation to the bobbin, comprising:

an upper shaft portion having a yarn inlet opening and a yarn passage extending from said inlet opening for passage of yarn through said upper shaft portion, said upper shaft portion being rotatably supportable above the bobbin by the bearing for rotation about an axis and said inlet opening being radially offset from said axis; and a body portion extending downwardly from said upper shaft portion and having a yarn passage extending from said yarn passage in said upper shaft portion to an outlet opening for passage of yarn traveling from said upper shaft portion through said body portion to the outside of said funnel for feeding to the bobbin.

2. A yarn feeding funnel according to claim 1 and characterized further in that said upper shaft portion is fixed to said body portion for rotation therewith.

3. A yarn feeding funnel according to claim 1 and characterized further in that said upper shaft portion includes a journal segment adapted to cooperate with the bearing for rotatably supporting said upper shaft portion and a top segment defining said yarn inlet opening, said top segment being fitted to said journal segment.

4. A yarn feeding funnel according to claim 3 and characterized further in that said top segment has a radial extent greater than said journal segment and said yarn inlet opening is located at a greater radial spacing from said axis then the periphery of said journal segment.

5. A yarn feeding funnel according to claim 3 and characterized further in that said top segment is releasably fitted to said journal segment.

6. A yarn feeding funnel according to claim 1 and characterized further in that a portion of said yarn passage in said upper shaft portion extends along said axis.

7. A yarn feeding funnel for use in a textile machine of the type in which yarn is wound on a bobbin and which has a bearing for rotatably supporting the yarn feeding funnel in yarn guiding relation to the bobbin, comprising:

an upper shaft portion having a yarn inlet opening and a yarn passage extending from said inlet opening for passage of yarn through said upper shaft portion, said upper shaft portion being rotatably supportable above the bobbin by the bearing for rotation about an axis and said inlet opening being radially offset from said axis;

a body portion extending downwardly from said upper shaft portion and having a yarn passage extending from said yarn passage in said upper shaft portion to an outlet opening for passage of yarn traveling from said upper shaft portion through said body portion to the outside of said funnel for feeding to the bobbin;

a yarn guiding eye for guiding yarn to said inlet opening; and means for adjusting the spacing of said yarn guiding eye and said inlet opening in a direction parallel to said axis.

8. A yarn feeding funnel for use in a textile machine of the type in which yarn is wound on a bobbin and which has a bearing for rotatably supporting the yarn feeding funnel in yarn guiding relation to the bobbin, comprising:

an upper shaft portion having a yarn inlet opening and a yarn passage extending from said yarn inlet opening for the passage of yarn through said upper shaft portion, said upper shaft portion being rotatably supportable above the bobbin by the bearing for rotation about an axis, said yarn inlet opening being radially offset from said axis and said yarn inlet opening having an angular extent with respect to said axis sufficiently limited to substantially preclude angular twist imparting movement of yarn at said yarn inlet opening; and a body portion extending downwardly from said upper shaft portion and having a yarn passage extending from said yarn passage in said upper shaft portion to an outlet opening for passage of yarn traveling from said upper shaft portion through said body portion to the outside of said funnel for feeding to the bobbin.

9. A yarn feeding funnel according to claim 8 and characterized further in that said angular extent is not greater than the radial extent of said yarn passage in said upper shaft portion.

* * * * *